US011248284B2

(12) United States Patent
Hwang

(10) Patent No.: US 11,248,284 B2
(45) Date of Patent: Feb. 15, 2022

(54) NON-MAGNETIC AUSTENITIC STEEL WITH GOOD CORROSION RESISTANCE AND HIGH HARDNESS

(71) Applicant: HPM Labs Co., LTD., Taipei (TW)

(72) Inventor: Kuen-Shyang Hwang, Taipei (TW)

(73) Assignee: HPM LABS CO., LTD., Taipei (TW)

( * ) Notice: Subject to any disclaimer, the term of this patent is extended or adjusted under 35 U.S.C. 154(b) by 158 days.

(21) Appl. No.: 16/548,114

(22) Filed: Aug. 22, 2019

(65) Prior Publication Data

US 2020/0248289 A1 Aug. 6, 2020

Related U.S. Application Data

(60) Provisional application No. 62/801,304, filed on Feb. 5, 2019.

(51) Int. Cl.

| | |
|---|---|
| ***C22C 38/44*** | (2006.01) |
| ***C22C 38/00*** | (2006.01) |
| ***C22C 38/50*** | (2006.01) |
| ***C22C 38/58*** | (2006.01) |
| ***C22C 38/02*** | (2006.01) |
| ***C22C 38/48*** | (2006.01) |
| ***C22C 38/42*** | (2006.01) |
| ***C22C 38/46*** | (2006.01) |

(52) U.S. Cl.

CPC ..... *C22C 38/42* (2013.01); *C22C 38/001* (2013.01); *C22C 38/02* (2013.01); *C22C 38/44* (2013.01); *C22C 38/46* (2013.01); *C22C 38/48* (2013.01); *C22C 38/50* (2013.01); *C22C 38/58* (2013.01)

(58) Field of Classification Search

CPC ..... B22F 3/10; C22C 38/001; C22C 38/02; C22C 38/44; C22C 38/48; C22C 38/50; C22C 38/58; C22C 38/42; C22C 33/02

USPC ..... 428/544

See application file for complete search history.

(56) References Cited

U.S. PATENT DOCUMENTS

2005/0194073 A1* 9/2005 Hamano ..... C22C 38/42 148/608

OTHER PUBLICATIONS

Cheng et al., "High-Strength Powder Injection Molded 316L Stainless Steel", International Journal of Powder Metallurgy, vol. 46, Issue 2, 2010, pp. 29-37, 9 pages.

* cited by examiner

*Primary Examiner* — Humera N. Sheikh
*Assistant Examiner* — Katherine A Christy
(74) *Attorney, Agent, or Firm* — Muncy, Geissler, Olds & Lowe, P.C.

(57) ABSTRACT

A non-magnetic austenitic steel with good corrosion resistance and a high hardness is provided. The non-magnetic austenitic steel comprises less than 0.15 wt % of carbon, less than 1.5 wt % of titanium, from 19 wt % to 26 wt % of chromium, from 3.5 wt % to 7.0 wt % molybdenum, from 11 wt % to 20 wt % nickel, from 2.0 wt % to 7.0 wt % of manganese, less than 0.8 wt % of nitrogen, less than 0.5 wt % of niobium, less than 0.5 wt % of vanadium, less than 1.2 wt % of silicon, less than 4 wt % of copper, and less than 2 wt % of tungsten and the balance being iron.

5 Claims, No Drawings

NON-MAGNETIC AUSTENITIC STEEL WITH GOOD CORROSION RESISTANCE AND HIGH HARDNESS

CROSS-REFERENCE TO RELATED APPLICATION

The present application claims the benefit of U.S. Provisional Patent Application No. 62/801,304, entitled "Method of producing high hardness powder metal corrosion resistant workpiece and workpiece thereof", which was filed on Feb. 5, 2019, and the disclosure of which is incorporated herein by reference in its entirety.

FIELD OF THE INVENTION

The present invention relates to a non-magnetic austenitic steel, and particularly to a non-magnetic austenitic steel with high hardness and good corrosion resistance.

BACKGROUND OF THE INVENTION

A corrosion-resistant austenitic stainless steel with complex shapes is often produced by investment casting, powder metallurgy, and machining processes. An as-cast product produced by the investment casting comprises a soft austenitic microstructure since the as-cast product is cooled slowly from high casting temperatures. For example, the yield strength of annealed or as-cast 316L stainless steels listed in the ASTM A276/A276M Standard is only 170 MPa. Moreover, the powder metallurgy process includes press-and-sinter process and metal injection molding (MIM) process. The as-sintered product produced by the powder metallurgy process also comprises a soft austenitic microstructure owing to the high temperature sintering. For example, as listed in the Metal Powder Industries Federation (MPIF) Standard 35-MIM (2018 ed.), the typical yield strength of the metal injection molded 316L stainless steels is 175 MPa, and the typical hardness is 67 HRB (equivalent to 119 HV).

The applications of the sintered or cast austenitic stainless steels are limited due to the softness and low strength. Although the work-hardening processes, such as sizing, coining, forging, and rolling, can increase the hardness and strength of austenitic stainless steels, it cannot produce complicated shapes.

Nonetheless, the machining process can solve the softness problem by using plates or bars. In detail, after the stainless steels are work-hardened by rolling or extrusion and then machined, the high hardness of the stainless steels can still be retained. A yield strength of a cold-finished wrought 316L stainless steel is 310-690 MPa listed in the ASTM A276/A276M Standard, which is much higher than the 175 MPa of the metal injection molded 316L stainless steels. However, the manufacturing cost of the machining process is relatively high since the machining process is time-consuming and wastes a lot of materials. Moreover, the austenitic stainless steels could become magnetic after the work-hardening processes. As a result, the annealing process has to be applied to make the austenitic stainless steels become non-magnetic, wherein the annealing process will add up the cost and decreases the hardness.

There are many applications that require the austenitic stainless steels with high corrosion resistance, high hardness, and non-magnetism. For example, the structural parts inside a mobile phone must be non-magnetic for communication reasons and corrosion-resistant. High hardness and high strength are also required because these parts are small, thin, and with complicated shapes. For instance, the socket is a part of the mobile phone that holds the camera. The socket has a very complex shape and its thickness is as thin as 0.12 mm in the cross-sections, and the socket requires high hardness and high strength to protect the camera. In general, the socket must pass the drop test without any permanent deformation nor malfunction after dropping from a designated height.

The socket is produced through several processes and materials. The work-hardened 316L stainless steels with a hardness of 20 HRC (236 HV) had been machined to meet the specifications in dimension of the socket, but the machined 316L stainless steel has a very high cost. The socket could also be made by the method that stamps the 316L sheets into several parts and then welds these parts together. The long stamping and welding processes are also expensive and it is difficult to maintain the precision and the quality of the welding process.

On the other hand, the metal injection molding (MIM) process is a common process of producing small net-shaped parts economically, and has been applied to replace machining process and stamping process for the sockets since 2016 to save the manufacturing cost. In the MIM process, metal powders are kneaded with binders to form a feedstock, and the feedstock is then injection molded into a green part. After removing the binder from the green part by using solvent, acid, and/or heat, the binder-free part is then sintered to high density. The main challenge of the MIM process is that a high sintering temperature is used and thus typical austenitic stainless steels cannot be used owing to their low hardness and strength. As a result, other harder and stronger materials must be used, such as the PANACEA (Fe-11Mn-17Cr-3Mo-0.8N) and the ASTM F75 (Co-28Cr-6Mo). However, these materials are often more expensive.

In detail, the PANACEA is a nickel-free material developed for users who are allergic to nickel. The PANACEA has a hardness higher than 250 HV, and also has a good corrosion resistance and is non-magnetic. To produce the PANACEA powder by atomization, a high pressure atmosphere is required during melting so that the high contents of nitrogen and manganese can be retained. Furthermore, the pressure of nitrogen in the sintering atmosphere must also be high in order to prevent the manganese from evaporation during sintering and to keep the super-saturated nitrogen (0.8 wt %) dissolved in the material. The sintering atmosphere is typically set as 800 mbar $N_2$ for vacuum furnaces or 1 atm 75% $N_2$+25% $H_2$ for continuous furnaces. Moreover, a fast cooling process must be adopted at the end of the sintering operation or performed independently in a separate heat treatment furnace. Otherwise, chromium nitride ($Cr_2N$) forms at part surfaces and deteriorates the mechanical and physical properties. The recommended cooling rate is greater than 150° C./min between 750° C. and 950° C. These processes require a specially-designed high pressure melting furnace to produce the powder, a specially-designed vacuum sintering furnace with a high partial pressure of 800 mbar or higher, and specially-designed fast cooling accessories in the furnace. The control on the composition of the sintered part is also difficult due to the complicated process. For these reasons, the manufacturing cost of injection molded PANACEA is high. The capital investment for special furnaces is also high.

There are other non-magnetic stainless steels with high strength, such as ASTM F2581 and ASTM F2229. These two stainless steels are high-nitrogen and high-manganese austenitic stainless steels and are often made by the wrought metallurgy process. These wrought steels are usually subsequently made to the final shape through the machining process or other secondary process. Since the contents of manganese and/or nitrogen in these two steels are even higher than those of PANACEA, the control of Mn and N during powder atomization and sintering becomes even more difficult compared to that of the PANACEA.

Other than the PANACEA, a F75(Co-28Cr-6Mo) alloy has also been widely used for applications such as sockets. Although there are no special requirements for the sintering atmosphere and furnaces, the cost of the raw F75 powder is also high and since cobalt is a strategic material and is expensive.

Accordingly, in order to resolve the problems of processing difficulties and high investment of the equipment for the PANACEA, and the high powder cost of the F75, the present invention provides a non-magnetic austenitic steel which is composed of new compositions. This non-magnetic austenitic steel can be used to make parts, such as sockets and others, that require high hardness, above 236 HV (20 HRC), good corrosion resistance, and non-magnetism. And the overall manufacturing cost of using this invention alloy is lower than those of the PANACEA and the F75.

SUMMARY OF THE INVENTION

The primary object of the present invention is to provide a low cost non-magnetic austenitic steel having a hardness much higher than 236 HV (20 HRC).

To achieve the object, the present invention provides a non-magnetic austenitic steel comprising less than 0.15 wt % of carbon, less than 1.5 wt % of titanium, 19 wt % to 26 wt % of chromium, 3.5 wt % to 7.0 wt % of molybdenum, 11 wt % to 20 wt % of nickel, 2.0 wt % to 7.0 wt % of manganese, less than 0.8 wt % of nitrogen, less than 0.5 wt % of niobium, less than 0.5 wt % of vanadium, less than 1.2 wt % of silicon, less than 4 wt % of copper, and less than 2 wt % of tungsten and the balance being iron.

In one embodiment, the non-magnetic austenitic steel is produced by a metal injection molding process, and the nitrogen is dissolved in a matrix during debinding under a nitrogen-containing atmosphere.

In one embodiment, the non-magnetic austenitic steel is produced by a metal injection molding process, and the nitrogen is dissolved in a matrix during sintering under a nitrogen-containing atmosphere.

In one embodiment, the non-magnetic austenitic steel is produced by a press-and-sinter process, and the nitrogen is dissolved in a matrix during debinding under a nitrogen-containing atmosphere.

In one embodiment, the non-magnetic austenitic steel is produced by a press-and-sinter process, and the nitrogen is dissolved in a matrix during sintering under a nitrogen-containing atmosphere.

The present invention also provides a sintered product and a fine powder with a median particle size of less than 10 μm, wherein the sintered product and the fine powder respectively comprise the composition of the alloy elements as mentioned above.

Accordingly, the present invention provides a non-magnetic austenitic steel which has a high hardness and a good corrosion resistance. Besides, the manufacture cost of the non-magnetic austenitic steel of the invention is low, so that the invention is more competitive against the conventional austenitic steel.

DETAILED DESCRIPTION OF THE PREFERRED EMBODIMENT

The present invention is generally directed to a non-magnetic austenitic steel with good corrosion resistance and high hardness. The non-magnetic austenitic steel comprises adequate amounts of titanium, molybdenum, niobium, vanadium, manganese, carbon, and nitrogen, in addition to the nickel and chromium in typical austenitic stainless steels, wherein the amounts of these alloying elements are carefully designed to make the non-magnetic austenitic steel has a high hardness, a good corrosion resistance, and a reasonable cost.

The non-magnetic austenitic steel includes less than 0.15 wt % of carbon (C), less than 1.5 wt % of titanium (Ti), from 19 wt % to 26 wt % of chromium (Cr), from 3.5 wt % to 7.0 wt % of molybdenum (Mo), from 11 wt % to 20 wt % of nickel (Ni), from 2.0 wt % to 7.0 wt % of manganese (Mn), less than 0.8 wt % of nitrogen (N), less than 0.5 wt % of niobium (Nb), less than 0.5 wt % of vanadium (V), less than 1.2 wt % of silicon (Si), less than 4 wt % of copper (Cu), less than 2 wt % of tungsten (W) and the balance of iron(Fe).

In one embodiment, the non-magnetic austenitic steel includes from 0.005 wt % to 0.10 wt % of C, from 0.1 wt % to 1.2 wt % of Ti, from 19 wt % to 26 wt % of Cr, from 3.5 wt % to 7.0 wt % of Mo, from 11 wt % to 20 wt % of Ni, from 2.0 wt % to 7.0 wt % of Mn, from 0.1 wt % to 0.8 wt % of N, less than 0.5 wt % of Nb, less than 0.5 wt % of V, from 0.2 wt % to 1.2 wt % of Si, less than 4 wt % of Cu, less than 2.0 wt % of W and the balance of Fe.

In another embodiment, the non-magnetic austenitic steel includes from 0.01 wt % to 0.10 wt % of C, from 0.1 wt % to 0.8 wt % of Ti, from 19 wt % to 26 wt % of Cr, from 3.5 wt % to 7.0 wt % of Mo, from 11 wt % to 20 wt % of Ni, from 2.0 wt % to 7.0 wt % of Mn, from 0.1 wt % to 0.6 wt % of N, less than 0.5 wt % of Nb, less than 0.5 wt % of V, from 0.3 wt % to 1.0 wt % of Si, less than 4 wt % of Cu, less than 2.0 wt % of W and the balance of Fe.

Specifically, some alloying elements, such as Mo, are dissolved in the Fe matrix and are distributed homogeneously to provide solution-hardening effect. Furthermore, reactive elements, such as Ti, Nb, and V could form fine and hard nitrides, carbides, carbo-nitrides, such as TiN, TiC, and TiCN, and other intermetallic compounds, such as $Ti_xNi_y$. These compounds provide dispersion strengthening effect to impede the grain growth during sintering and improve the hardness of the non-magnetic austenite. The presence of Ti also helps the reduction of the grain size. In addition, W and Cu play similar roles as Mo and Ni do.

Too much Ti will cause difficulties in melting and powder atomization since Ti is very reactive and could react with refractories. Further, too much Ti and Mo will also cause problems in corrosion resistance and magnetism since both Ti and Mo are strong ferrite stabilizers. In addition, chromium carbides ($Cr_{23}C_6$) and nitrides ($Cr_2N$) will be formed with excessive carbon and nitrogen, resulting in a Cr-lean region surrounding these compounds, which is not corrosion resistant. Thus, the present invention provides a non-magnetic austenitic steel with a composition in which the amounts of carbon and nitrogen are carefully optimized with the amounts of Ti, Nb, V, W, etc. to achieve a balance of corrosion resistance and mechanical properties.

In addition to the optimization of the elements composition, the particle size of the powder used in the metal injection molding process also affects the sintered hardness. Cheng and Hwang(Li-Hui Cheng and Kuen-Shyang Hwang, "High-Strength Powder Injection Molded 316L Stainless Steel", Int. J. Powder Metallurgy, Vol. 46, No. 2, 2010, pp. 29-37.) showed that when the fine powder helps to reduce the grain size in sintered parts and thus further improves the hardness. For example, a 316L stainless steel powder with a $D_{50}$ of 12 μm was injection molded, debound, and then sintered in dissociated ammonia at 1350° C. for 2 hours. The density was about 7.3 g/cm$^3$, grain size was about 57 μm, and the hardness was 70 HRB (equivalent to 125 HV). When the powder with a $D_{50}$ of 4.1 μm was used, the density of the part sintered at 1120° C. for 2 hours was higher, at about 7.6 g/cm$^3$. The grain size decreased to 10 μm and the hardness increased to 95 HRB (210 HV).

The non-magnetic austenitic steel of the invention could be produced via several manufacture process. For example, the nitrogen could be added into the melt during the melting process under a high pressure nitrogen atmosphere. Nitrogen-containing master alloy or compounds, such as $Cr_2N$, could also be used as the additive for melting. In the case of the MIM process, N could be added during the debinding and sintering process under a nitrogen-containing atmosphere, such as pure nitrogen or dissociated ammonia.

The non-magnetic austenitic steel could also be produced by mixing a master alloy powder with Ni powder, Mo powder, or other elemental metal powders. Then, the mixed powders are formed into green parts via the MIM process or press-and sinter process. Further, the mixed powders are sintered at high temperatures where interdiffusion of the alloying elements could proceed. A sintered compact with a homogeneous microstructure and with a uniform said composition can thus also be attained.

Moreover, the non-magnetic austenitic steel has a high chromium equivalent ($Cr_{eq}$) to provide the corrosion resistance and a high nickel equivalent ($Ni_{eq}$) to form austenitic structure which makes the austenitic steel non-magnetic. The $Cr_{eq}$ and $Ni_{eq}$ should be matched so that the composition will fall in the austenite region in the Schaeffler Diagram. Since the equations used to calculate the $Cr_{eq}$ and $Ni_{eq}$ for the Schaeffler Diagram does not cover all the elements in the invention and there are interactions between the reactive elements and carbon/nitrogen, it is almost impossible to predict whether a workpiece will have an austenite structure. Thus, a permeability tester and a rare earth Nd—Fe—B magnet were used to check the magnetism of the invention.

The non-magnetic austenitic steel of the invention can be prepared by various processes. In one embodiment, the non-magnetic austenitic steel is prepared via vacuum arc melting. In another embodiment, the non-magnetic austenitic steel is prepared via MIM process. In addition, the press-and-sinter process (traditional powder metallurgy), investment casting, and casting followed by rolling or forging could also be used.

The improvement afforded by the present invention may be exemplified by the following examples which are formed in accordance with the present invention.

Example 1

A workpiece is prepared by arc melting to form the non-magnetic austenitic steel. The composition of the workpiece comprises 0.013 wt % C, 0.45 wt % Ti, 22.4 wt % Cr, 4.3 wt % Mo, 16.3 wt % Ni, 5.1 wt % Mn, 0.3 wt % N, 0.25 wt % Nb, 0.32 wt % V, 0.7 wt % Si, the rest of iron and unavoidable impurities. The hardness of the workpiece is 280 HV. The workpiece passes 72-hours salt spray test and is proved to be non-magnetic.

Example 2

A pre-alloyed powder with a median particle size of 9 μm with a composition in the range as Example 1. The pre-alloyed powder is kneaded with a wax-based binder and then molded to form a workpiece. After removing the wax with a solvent, the workpiece is placed in a vacuum furnace with a partial pressure of nitrogen at 100 Torr. The workpiece is slowly heated between 400° C. and 600° C. at a rate of 1° C./min and then held at 600° C. for 1 hour to remove all the remaining binders. After this thermal debinding process, the binder-free part is held at 1150° C., where the solubility of nitrogen in the matrix is high and the pores inside the workpiece are still interconnected, allowing N to penetrate into the core region. After absorbing nitrogen for 1 hour at 1150° C., the workpiece is sintered at 1280° C. for 3 hours. After sintering, the part was furnace cooled to 900° C. followed by fan cooling inside the furnace to prevent the formation of $Cr_2N$. This thermal debinding, sintering, and cooling process is typical for the MIM processing. The sintered workpiece attains a density of 7.6 g/cm$^3$, a grain size of 50 μm, a hardness of 290 HV, and a tensile strength of 680 MPa. The final composition of the sintered workpiece is 0.04 wt % C, 0.65 wt % Ti, 22.7 wt % Cr, 4.7 wt % Mo, 16.3 wt % Ni, 5.3 wt % Mn, 0.36 wt % N, 0.26 wt % Nb, 0.28 wt % V, 0.6 wt % Si. The workpiece passes 72-hour salt spray test and is proved to be non-magnetic.

Example 3

The same powder used in Example 2 is granulated to spherical powders by using a wax-based binder to improve its flowability. The granulated powder is pressed into discs with a conventional compacting press and then sintered with the same sintering conditions as those used in Example 2 to form a sintered workpiece. The sintered workpiece attains a density of 7.65 g/cm$^3$, a grain size of 45 μm, and a hardness of 295 HV. The sintered workpiece passes 72-hour salt spray test and is proved to be non-magnetic.

The Examples 2 and 3 indicate that a MIM/PM workpiece can be prepared by using a pre-alloyed atomized powder with the composition described above and then add nitrogen during debinding or sintering to improve the hardness. Fine powders can also be used to further increase the hardness of the sintered MIM workpiece.

It is noted that the above-mentioned embodiments are only for illustration. It is intended that the present invention cover modifications and variations that fall within the scope of the following claims and their equivalents.

What is claimed is:

1. A non-magnetic sintered austenitic steel, consisting of:
less than 0.15 wt % of carbon;
less than 1.5 wt % of titanium;
19 wt % to 26 wt % of chromium;
3.5 wt % to 7.0 wt % of molybdenum;
16 wt % to 20 wt % of nickel;
2.0 wt % to 7.0 wt % of manganese;
less than 0.4 wt % of nitrogen;
less than 0.5 wt % of niobium;
less than 0.5 wt % of vanadium;
less than 1.2 wt % of silicon;
less than 4 wt % of copper;
less than 2 wt % of tungsten; and
the balance being iron.

2. The non-magnetic sintered austenitic steel as claimed in claim 1, wherein the non-magnetic sintered austenitic steel is produced by a metal injection molding process, and the nitrogen is dissolved in a matrix during debinding under a nitrogen-containing atmosphere.

3. The non-magnetic sintered austenitic steel as claimed in claim 1, wherein the non-magnetic sintered austenitic steel is produced by a metal injection molding process, and the nitrogen is dissolved in a matrix during sintering under a nitrogen-containing atmosphere.

4. The non-magnetic sintered austenitic steel as claimed in claim 1, wherein the non-magnetic sintered austenitic steel is produced by a press-and-sinter process, and the nitrogen is dissolved in a matrix during debinding under a nitrogen-containing atmosphere.

5. The non-magnetic sintered austenitic steel as claimed in claim 1, wherein the non-magnetic sintered austenitic steel is produced by a press-and-sinter process, and the nitrogen is dissolved in a matrix during sintering under a nitrogen-containing atmosphere.

* * * * *